United States Patent [19]

Kape

[11] 4,426,252

[45] Jan. 17, 1984

[54] PROCESS AND COMPOSITION FOR PREPARING ALUMINUM SURFACES FOR ANODIZING

[75] Inventor: James M. Kape, Crookham Village, England

[73] Assignee: Pennwalt Corporation, Philadelphia, Pa.

[21] Appl. No.: 492,757

[22] Filed: May 9, 1983

[30] Foreign Application Priority Data

Sep. 23, 1982 [GB] United Kingdom ..... 8227118

[51] Int. Cl.[3] ..... C23F 1/00; B44C 1/22

[52] U.S. Cl. ..... 156/665; 252/79.2; 252/79.3; 427/309

[58] Field of Search ..... 252/79.2, 79.3, 142; 156/665; 204/33; 427/309; 134/3, 41; 423/301

[56] References Cited

U.S. PATENT DOCUMENTS 2,729,551 1/1956 Cohn ..... 156/665

*Primary Examiner*—William A. Powell

[57] ABSTRACT

Aluminum is cleaned and etched prior to anodizing using solutions containing dilute hexafluorophosphoric acid and, optionally, nitric acid.

10 Claims, No Drawings

PROCESS AND COMPOSITION FOR PREPARING ALUMINUM SURFACES FOR ANODIZING

BACKGROUND OF THE INVENTION

Aluminum extrusions are cleaned, etched and anodized for architectural and home improvement applications. The etching treatment is important in producing a finished product having the desired appearance. In current commercial practice, aluminum extrusions, mainly to alloy specification 6063 (magnesium and silicon), are etched in a caustic soda based solution at temperatures of 50°–70° C. The solution contains additives including sequestering agents, smoothing agents (sulfides) and, often, surfactants, in order to help achieve a uniform satin appearance prior to anodizing. Such solutions often have long life properties and provide a quite uniform finish. Caustic based solutions produce a whitish, satin appearance on the surface which retains a considerable degree of reflectance even after anodizing in sulfuric acid to a thickness of 15–25 micrometers. With the advent of electropainting of aluminum, in particular with a white finish, there is a need to produce a dull, low reflectance, more matte, dense, white or grayish white anodized surface. The surface produced by the caustic soda based etching solutions is not dense enough. Also, the caustic content has to be carefully controlled and the baths are unpleasant to use and the sulfide additions have to be oxidized before discharge.

Solutions containing fluorine compounds are known for cleaning and etching aluminum, for example, as are described in U.S. Pat. No. 4,124,407 which discloses mixtures of HF and $H_2SO_4$ for cleaning with little or no etching, U.S. Pat. No. 3,634,262, which discloses perdiphosphate compound and a fluoride salt for preparing surfaces for anodizing, and U.S. Pat. No. 4,230,522, which discloses a mixture of phosphoric acid, nitric acid, acetic acid and a fluoroborate anion containing compound for etching thin films of aluminum. Etchants based on hydrofluoric acid or ammonium bifluoride have been used successfully to produce a very white finish on sheet materials suitable for nameplate applications. When used on 6063 alloy extrusions, however, hydrofluoric acid based solutions act as metallographic etchants which reveal grain structure and other metal faults or structure. I have now found that certain solutions based on dilute hexafluorophosphoric acid provide smooth, white, matte surfaces which are especially suitable prior to electropainting or anodizing.

BRIEF SUMMARY OF THE INVENTION

In accordance with the invention, there is provided a process for etching aluminum alloys to provide a matte surface comprising contacting the surface with an aqueous solution containing at least about 0.5% by volume of hexafluorophosphoric acid and optionally, small amounts of nitric acid.

Also provided are etching solutions comprising at least about 0.5% by volume of hexafluorophosphoric acid and from about 0.5% to 2.5% by volume of nitric acid.

DETAILED DESCRIPTION

The preparation of hexafluorophosphoric acid, $HPF_6$, and its uses as a non-oxidizing catalyst in organic reactions and as an electrolyte are described, for example, in U.S. Pat. No. 2,488,298. Hexafluorophosphoric acid has also been disclosed in U.S. Pat. No. 4,076,779 along with other fluorine containing acids such as HF, for removing silicate material from porous, ceramic, fluid release molds.

In the process of the invention, concentrations of at least about 0.5%, and preferably from about 1.0% to 5.0%, by volume of hexafluorophosphoric acid in water, at solution temperatures of from about 10° C. to 70° C., provide a very suitable etching medium for providing a matte surface on aluminum alloys. Concentrations above 5.0% by volume can be used, but are expensive and provide no additional benefits. The etch times usually vary from less than one minute to 30 minutes. Longer times can be used, especially at low temperatures. The amount of etch and whitening increases with temperature and time. Smooth, white, matte, etched surfaces are obtained by treating 6063 alloy extrusions with etch solutions containing, for example, from about 1.0% to 5.0% by volume of hexafluorophosphoric acid for 30 seconds to 20 minutes at temperatures of from 20° C. to 60° C. The whitening effect is increased by adding from about 0.5% to 2.5% by volume of nitric acid (70% wt S.g. 1.42) to the etch solution and metallographic etching is further reduced.

Prior to the etching, all oxide coatings and grease and oil should be removed from the surface. This can be accomplished by precleaning using, for example, either conventional alkaline cleaners or caustic based etch solutions.

The process can be used to provide a matte surface on a variety of aluminum alloys. Above a 99.80 aluminum purity, very little matting occurs. Alloys which respond well to the process of the invention include, for example, alloy specifications 1200, 3103, 5251, 6063, 6061 and 6082. Cast alloys with no more than 1% by weight of silicon also react favorably.

Following treatment, anodizing the surface under standard commercially used conditions causes the whiteness of the surface to diminish and be slowly substituted by a greyish appearance. The greyness increases with increasing anodic film thickness. At 5 micrometers it is negligible, at 12.5 micrometers it is evident, and at 25 micrometers it is very pronounced.

If desired, the original white matte of the surface could easily be preserved by coating with a clear lacquer of low surface gloss characteristics.

EXAMPLE

To further illustrate the process of the invention, precleaned samples of 6063 alloy extrusion (0.20–0.60 silicon, 0.35 iron, 0.10 copper; 0.10 manganese, 0.45–0.9 magnesium, 0.10 chromium, 0.10 zinc, 0.10 titanium, 0.05 others, remainder to equal 100.00, aluminum) measuring 87.0 square centimeters were etched by placing them in solutions containing 2.5% or 5% by volume hexafluorophosphoric acid (Sg. 1.8) and in solutions containing 2.5% or 5% by volume hexafluorophosphoric acid with 1.0% to 1.5% by volume of nitric acid (Sg. 1.42) added. The samples were etched for periods of five minutes up to several hours at temperatures of 25° C. to 65° C. The degree of etching or matting down of the surface as determined by the whiteness or greyness of the surface, varied with etch temperature and time of etching. The determination of weight loss was found to be a satisfactory quantitative method of assessing a satisfactory etch response. As a general rule, weight losses of less than about 0.0012 gm/cm$^2$ of specimen surface gave an unsatisfactory matting. Accordingly, at 25° C. in all the solutions, a weight loss of 0.0012 gm/cm$^2$ required more than 1 hour of etching. In order to achieve a good matte finish at 40° C., 10–15 minutes etch time was required, at 60° C., 5 minutes and at 65°–70° C., 2–3 minutes. The weight loss to achieve an excellent matte finish was generally found to be from about 0.0024 to 0.0036 gm/cm$^2$. This matting was observed to be far greater than that achieved in the conventional caustic soda based etches which remove up to twice the amount of metal at temperatures of 65°–70° C. The samples etched with the nitric acid containing solutions of the invention had an increased whitening effect and even less tendency to reveal grain structure.

As a comparison with the process of the invention, the etch rate of a 5.0% by volume aqueous solution of hydrofluoric acid (70% by weight) at any given temperature was about seven times that of $HPF_6$. The finish achieved tended to be brighter and more grainy than in $HPF_6$; that is, the HF etchant acted as a grain boundary etch, and is indeed regarded as a metallographic etch for aluminum alloys which is intended to reveal the grain structure of various alloys.

As a further comparison, 5.0% Vol solutions of caustic soda, both with and without additives to improve the etch quality gave brighter (less matte) surfaces at any given temperature as was demonstrated by re-etching the sample in an etchant solution of the invention.

Using an etch composed of a stoichiometric composition of HF and $H_3PO_4$ in accordance with the hydrolysis reaction equation, (based on 5% Vol $HPF_6$)

$$HPF_6 + 4H_2O \rightarrow H_3PO_4 + 6HF$$

a far less matte finish resulted with at least twice the etch rate at any given temperature compared to $HPF_6$.

The foregoing invention provides an improved etch composition and process for obtaining a matte surface on aluminum alloys. The composition has a high tolerance for aluminum removed by the etching and gives an increased matting over conventional acid or caustic etchants while removing less material.

I claim:

1. A process for etching aluminum alloys to provide a matte surface comprising contacting the surface with an aqueous solution containing hexafluorophosphoric acid.

2. The process of claim 1 wherein the solution contains at least about 0.5% by volume of hexafluorophosphoric acid.

3. The process of claim 2 wherein the solution contains from about 0.5 to 5.0% by volume of hexafluorophosphoric acid.

4. The process of claim 1 wherein the solution is at a temperature of from about 10° C. to 70° C. and the surface is contacted with the solution for from about 30 seconds to about 30 minutes.

5. The process of claim 1 wherein the solution contains nitric acid.

6. The process of claim 5 wherein the solution contains from about 0.5 to 2.5% by volume of nitric acid.

7. The process of claim 1 wherein the solution is at a temperature of about 20° C. to 60° C. and the surface is contacted with the solution for from about 30 seconds to 30 minutes.

8. An etching composition comprising a dilute aqueous solution of hexafluorophosphoric acid and nitric acid.

9. The etching composition of claim 8 wherein the solution contains at least about 0.5% by volume of hexafluorophosphoric acid and at least about 0.5% by volume of nitric acid.

10. The etching composition of claim 8 wherein the solution contains from about 0.5 to 5.0% by volume of hexafluorophosphoric acid and from about 0.5 to 2.5% by volume of nitric acid.

* * * * *